United States Patent [19]

Lenk

[11] Patent Number: 4,681,522

[45] Date of Patent: Jul. 21, 1987

[54] MELT SPINNING APPARATUS

[75] Inventor: Erich Lenk, Remscheid, Fed. Rep. of Germany

[73] Assignee: Barmag AG, Remscheid, Fed. Rep. of Germany

[21] Appl. No.: 767,480

[22] Filed: Aug. 20, 1985

[30] Foreign Application Priority Data

Aug. 22, 1984 [DE] Fed. Rep. of Germany ..... 3430847

[51] Int. Cl.[4] ..... B29C 47/30

[52] U.S. Cl. ..... 425/72 S; 425/192 S; 425/382.2; 425/DIG. 217

[58] Field of Search ..... 425/72 S, 182, 131.5, 425/190, 191 S, 192 S, 378 S, 461, 379 S, 197, 382.2, 464, 198, 378 R, 379 R, DIG. 49, DIG. 217; 264/176 F, 177.13

[56] References Cited

U.S. PATENT DOCUMENTS

| | | | |
|---|---|---|---|
| 2,707,306 | 5/1955 | Weber et al. | 425/378 S X |
| 3,067,458 | 12/1962 | Dauchert | 425/72 S X |
| 3,104,419 | 9/1963 | La Forge | 425/198 X |
| 3,234,596 | 2/1966 | Sims | 425/72 S |
| 3,262,153 | 7/1966 | Mercer et al. | 425/DIG. 217 |
| 3,407,437 | 10/1968 | Lenk | 425/376 A |
| 3,460,199 | 8/1969 | Heckrotte et al. | 425/131.5 |
| 3,479,692 | 11/1969 | Van Den Biggelaar | 425/190 |
| 3,480,995 | 12/1969 | Lenk | 425/464 |
| 3,509,598 | 5/1970 | Van Den Biggelaar | 425/190 X |
| 3,521,324 | 7/1970 | Hartmann | 425/192 S X |
| 3,546,328 | 12/1970 | Lodge et al. | 425/198 X |
| 3,553,774 | 1/1971 | Ruck et al. | 425/131.5 |
| 3,672,801 | 6/1972 | Caldwell et al. | 425/464 X |
| 3,705,227 | 12/1972 | Fintel et al. | 425/72 S X |
| 4,038,005 | 7/1977 | Lenk | 425/190 |
| 4,361,489 | 11/1982 | Kilsdonk et al. | 425/197 X |
| 4,494,921 | 1/1985 | Sowell | 425/72 S X |

FOREIGN PATENT DOCUMENTS

| | | | |
|---|---|---|---|
| 3406347 | 10/1984 | Fed. Rep. of Germany . | |
| 148904 | 11/1981 | Japan | 425/72 S |
| 830441 | 3/1960 | United Kingdom | 425/131.5 |
| 2135629A | 9/1984 | United Kingdom . | |

*Primary Examiner*—Richard L. Chiesa

*Attorney, Agent, or Firm*—Bell, Seltzer, Park & Gibson

[57] ABSTRACT

A melt spinning apparatus is disclosed which includes a spin block and a spinning nozzle assembly which is threadedly joined to the spin block. Also, an axially movable protective tube is disposed coaxially at the outlet end of the spinning nozzle assembly, and the upper end of the tube mounts casing assembly means in the form of a rotatable flat plate or an annular ring, for engaging the nozzle assembly and thereby facilitating threaded assembly of the nozzle assembly to the block as well as disassembly of the nozzle assembly from the block.

16 Claims, 4 Drawing Figures

MELT SPINNING APPARATUS

The present invention relates to a melt spinning apparatus for extruding and spinning thermoplastic filaments, and more particularly to a melt spinning apparatus which includes a nozzle assembly which is removably mounted to facilitate its periodic cleaning or repair.

Melt spinning apparatus are known which include a stationary melt supply block, and a nozzle assembly which is removably mounted to the block to facilitate the periodic cleaning or repair of the apparatus. For example, copending and commonly owned U.S. application Ser. No. 738,170, filed May 24, 1985, discloses a melt spinning apparatus of this general type, and wherein the nozzle assembly includes an outer tubular casing which is threadedly mounted to the block so that the casing and thus the entire nozzle assembly may be removed from and then re-assembled to the block by rotation of the casing.

It is also recognized that the newly spun filaments are very sensitive as they exit from the nozzle assembly, and it has been previously proposed to mount a spinning tube at the outlet end of the spinning nozzle assembly so as to enclose and protect the newly spun filaments as they leave the nozzle assembly. However, the presence of a protective spinning tube of this type has rendered it difficult to threadedly or otherwise remove the spinning nozzle assembly for periodic cleaning or repair.

It is accordingly an object of the present invention to provide a melt spinning apparatus which includes a threadedly removable spinning nozzle assembly, and which also includes a cooperating spinning tube which serves to protect the newly spun filaments and which does not interfere with the periodic removal of the spinning nozzle assembly.

It is a more particular object of the present invention to provide a melt spinning apparatus having a nozzle assembly which includes a threadedly removable tubular casing, together with a protective spinning tube, and wherein the spinning tube mounts assembly means for supporting the casing and facilitating the threaded assembly and disassembly of the casing with respect to the melt supply block.

It is a further object of this invention to provide a melt spinning apparatus which permits the assembly and disassembly of the nozzle casing by a robot or any other type of automated mechanism.

These and other objects and advantages of the present invention are achieved in the embodiment illustrated herein by the provision of a melt spinning apparatus which comprises a spinneret which includes a melt supply block and a nozzle assembly, and with the nozzle assembly including a tubular casing threadedly mounted to the melt supply block so as to define a central axis. A spinning tube is disposed in coaxial alignment with the tubular casing of the nozzle assembly, and the spinning tube is mounted so that at least the portion thereof adjacent the outlet end of the tubular casing is axially movable between an operative position in contact with the outlet end and an axially withdrawn position. Further, the apparatus includes casing assembly means mounted to the end of the spinning tube adjacent the outlet end of the casing for facilitating threaded assembly of the tubular casing to the melt supply block, and with the casing assembly means being mounted for rotation about the central axis and including means for engaging the outlet end of the casing so as to impart rotation thereto upon rotation of the casing assembly means.

In the preferred embodiment, the spinning tube comprises two telescopically interconnected tube sections, with a first section being disposed adjacent the outlet end of the casing and a second section being disposed axially remote from the outlet end. Also, the means mounting the spinning tube includes means fixing the second tube section so that the first tube section may telescope thereinto and thus move axially toward and away from the outlet end of the casing. By this arrangement, the first tube section may be moved away from the spinneret when work is to be performed thereon, and such movement also facilitates the exchange of nozzle assemblies.

It is also preferred that the end portion of the spinning tube adjacent the casing includes a plurality of perforations, and that the apparatus further includes a blowing chamber surrounding the perforated end portion of the spinning tube for supplying a pressurized gas thereto.

The casing assembly means which is mounted upon the end of the spinning tube adjacent the outlet end of the casing, may take the form of a flat plate which is rotatably supported at the end of the spinning tube. Also, the casing preferably includes a plurality of axially directed bores at the outlet end thereof, and the plate includes a like number of axial pins for engaging respective ones of the apertures. The plate may be mounted in a shallow recess on the upper surface of a flange mounted to the end of the spinning tube, and for the purpose of reducing friction, the underside of the plate may be provided with a narrow annular bead, which contacts the bottom surface of the shallow recess. Also, to facilitate rotation of the plate, the outer periphery thereof may be provided with surface means which is adapted to be engaged by a turning tool. For example, the surface means may comprise at least one radial aperture for receiving a turning tool such as a rod. Upon completion of the exchange of the nozzle assembly, the plate may be removed, and an air tight connection established between the spinning tube and the spinning nozzle assembly. However, it is also possible to leave the plate permanently positioned on the flange, in which case the plate must include a bore for the free passage of the filaments. To limit the dissipation of heat from the nozzle assembly to the plate, the surface of the plate upon which the nozzle assembly is seated is preferably covered by a suitable insulation material.

In an alternative embodiment of the present invention, the casing assembly means which is mounted at the end of the spinning tube comprises an annular ring which is permanently assembled to the flange mounted on the end of the spinning tube. More particularly, the annular ring is permanently assembled to the end of the telescopically movable first section of the spinning tube by an arrangement wherein the ring is fitted into a cylindrical inside bore of the flange mounted at the upper end of the spinning tube. The annular ring includes on its outer peripheral surface one or more thread grooves having a relatively large pitch, and a number of slide pins are provided on the inside surface of the bore of the flange which correspond in number to the number of grooves and their spacing from each other. The pins are directed radially inwardly, and are received in respective ones of the grooves. The thread grooves have the same inclination or pitch.

To retain the annular ring in its idle position, i.e. after the nozzle assembly has been installed, the grooves terminate at a minimum distance of about 0.3 mm from the upper surface of the ring, while the lower ends of the grooves are open. Alternatively, the annular ring may be provided at its upper edge with a retaining collar. To avoid the projection of the collar above the surface of the supporting flange, the flange may have a recess in its upper surface for receiving the collar. Also in this embodiment, the surface of the ring which is in contact with the nozzle casing may be covered with a pressure and heat resistant insulating material.

To reduce the friction between the walls of the thread grooves and the slide pins on the flange, the slide pins may be provided with cylindrical bushings which smoothly rotate about the pins. Also, it is advantageous to provide stoppages which connect the annular ring and the tubular casing of the nozzle assembly. Such stoppages have the effect of mechanically transferring the rotational motion of the annular ring to the nozzle casing both for assembly and disassembly of the nozzle casing.

It is desirable to produce an air tight connection between the spinning nozzle and the spinning tube, and a suitable seal should be chosen which takes into consideration the unavoidable variation in dimensions. A bellows type seal may be positioned between the tube and casing for this purpose.

Some of the objects and advantages of the present invention having been stated, others will appear as the description proceeds, when taken in conjunction with the accompanying drawings, in which FIG. 1 is a schematic side elevation view of a melt spinning apparatus which embodies the features of the present invention;

Figure 4:
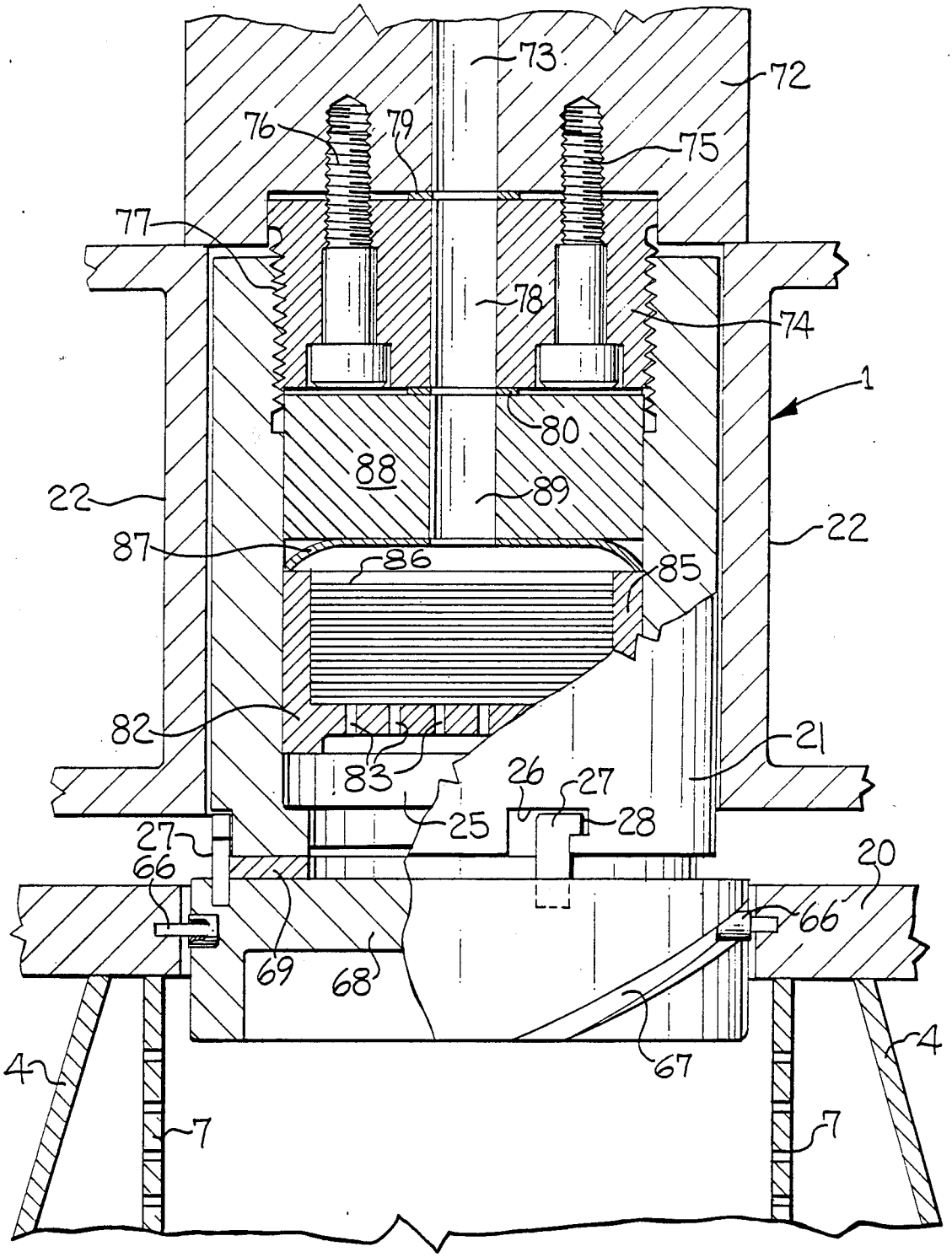
FIG. 4 is a sectional side elevation view of a spinneret and casing assembly means in accordance with the present invention.

Referring more particularly to the drawings, FIG. 4 illustrates a spinneret 1 of a type adapted for use with the present invention. The spinneret 1 includes a melt supply block 72, which is surrounded by a heating box (not shown). A melt supply line 73 extends vertically through the block 72 and supplies the melt to the apparatus. In the specific illustrated embodiment, the block 72 is provided with a recess, into which the mating upper end of a connecting plug 74 is fitted. An annular gasket 79 is positioned between the connecting plug 74 and the pump block 72 in coaxial alignment with the line 73, and forms a tight and pressure resistent sealed joint. The force of the sealing contact is provided by a plurality of fastening bolts 75, 76 which penetrate and hold the connecting plug 74 in position in a downwardly depending position below the block 72.

The downwardly depending portion of the connecting plug 74 is cylindrical and has a thread 77 cut into its outer circumference, which may be a bayonet joint or a multiple, self-locking thread which may be quickly tightened or released. A joint of this type is further described in copending application Ser. No. 738,170, filed May 24, 1985.

The spinneret 1 further includes a nozzle assembly, which includes an outer tubular casing 21 having a cylindrical bore and a shoulder at the lower end of the bore. The casing 21 and plug 24 define a central axis 24, and the casing 21 encloses and supports a spinning nozzle 25 and a distribution spin plate 82 having a plurality of openings 83 extending therethrough. The spin plate 82 includes an upwardly extending cylindrical outer wall which defines a cup-like receptacle 85.

The nozzle 25 is also in the form of a plate having small openings (not shown) therethrough, with the openings in the nozzle usually being smaller in size and larger in number than the openings 83 of the plate 82. It will also be seen that the casing 21 and spin plate 82 define a cavity on the upper side of the plate 82. Further, a filter pack 86 is positioned in the cup-like receptacle 85 of the spin plate 82. In order to provide for a pressure resistant and tight connection between the nozzle assembly and the connecting plug 74, a piston 88 is positioned in the cavity above the cup-like receptacle 85 of the distribution plate 82, so that the piston 88 forms the upper end portion of the nozzle assembly. The piston 88 includes a through duct 89 which is aligned with the duct 78 of the connecting plug 74, and the piston 88 is sealed against the upper edge of the cylindrical wall of the plate 82 by an inverted plate-shaped sealing diaphragm 87. The diaphragm has an opening which is in alignment with the duct 89 of the piston 88. An annular sealing gasket 80 is provided between the upper end of the piston 88 and the lower end of the connecting plug 74, and in coaxial alignment with the supply duct 78 in the plug 74.

In order to assemble the nozzle assembly to the connecting plug 74, the nozzle assembly is pushed upwardly onto the thread 77 of the connecting plug 74, and tightened by a short rotation of the casing 21, such as about sixty degrees.

Figure 1:
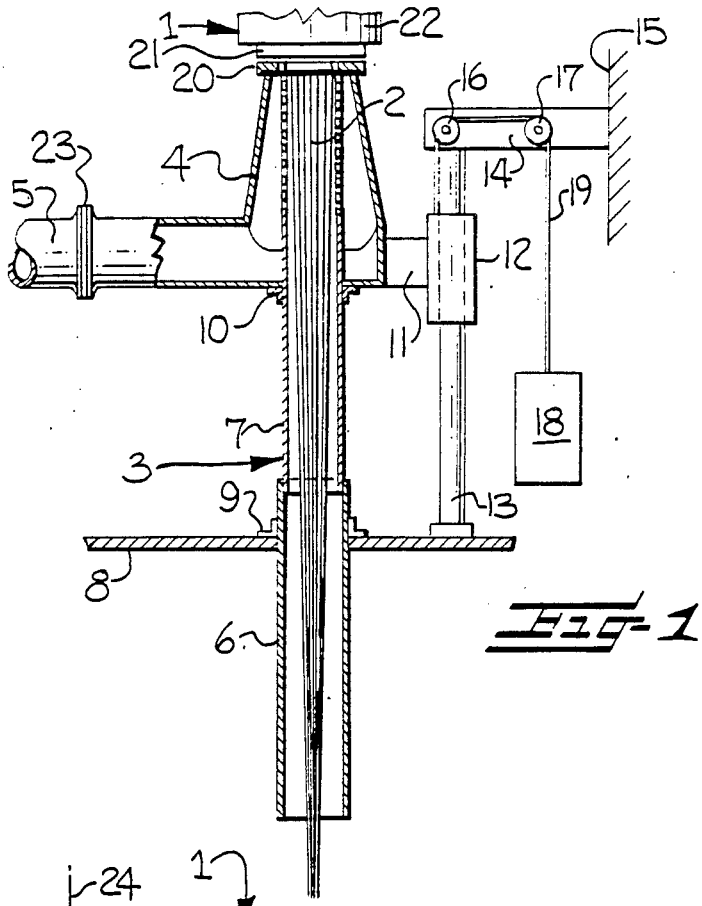

Referring now to the remaining portions of the melt supply apparatus as shown in FIG. 1, there is illustrated a spinning tube 3 which extends in the extrusion direction of the filaments 2, which is aligned with the central axis 24 and usually extends vertically downwardly. The spinning tube comprises two telescopically interconnected tube sections 6 and 7, and the upper end of the upper section 7 directly communicates with the outlet end of the tubular casing 21. Also, the upper portion of the section 7, and which is positioned immediately adjacent the spinneret 1, is surrounded by a blowing chamber 4 having an air supply 5. The upper section 7 and the blowing chamber 4 are fixedly connected to each other, and are movable in the vertical direction. The lower section 6 of the tube is stationary and mounted to the support 8. The upper section 7 may thus move telescopically into the section 6. Also, the upper movable section 7 of the tube 3 includes a plurality of perforations, which may be in the form of apertures, or provided by a porous material in the region directly adjacent the spinneret. A further description of a blowing chamber 4 and perforated upper chamber 7 of this type may be obtained from published British application No. 2 135 629A and published German application No. 34 06 347.

The lower section 6 of the spinning tube 3 passes through the support 8, and it is fixed thereto by a suitable mounting flange 9. The support 8 may also be designed to support personnel for servicing the spinning stations. The movable section 7 of the spinning tube is located above the support 8 and adjacent the spinneret 1, and it is connected to the blowing chamber 4 by a flange 10 to produce a unitary assembly. The blowing chamber 4 and the upper section 7 are supported by an arrangement which includes a support arm 11 and a guide block 12. A vertical slide column 13 is mounted to the support 8 and slideably receives the block 12, so that the block 12 and also the assembly of the tube section 7 and blowing chamber 4, may reciprocate in a vertical direction. As illustrated, the column 13 is also connected to a fixed wall 15 by means of a cross bar 14. Deflection rollers 16 and 17 are positioned on the cross bar 14, and a cable 19 which is connected to the block 12 runs over the rollers 16 and 17 to a depending counterweight 18.

During a spinning operation, the blowing chamber 4 and the upper tube section 7 are in contact with the outlet end of the tubular casing 21, by means of the flange 20 which is fixedly mounted at the upper end of the section 7 and chamber 4. In this position, the blowing chamber 4 is connected to the air supply line 5 by means of a quick release connection 23 which is adjacent the blowing chamber 4.

Figure 2:
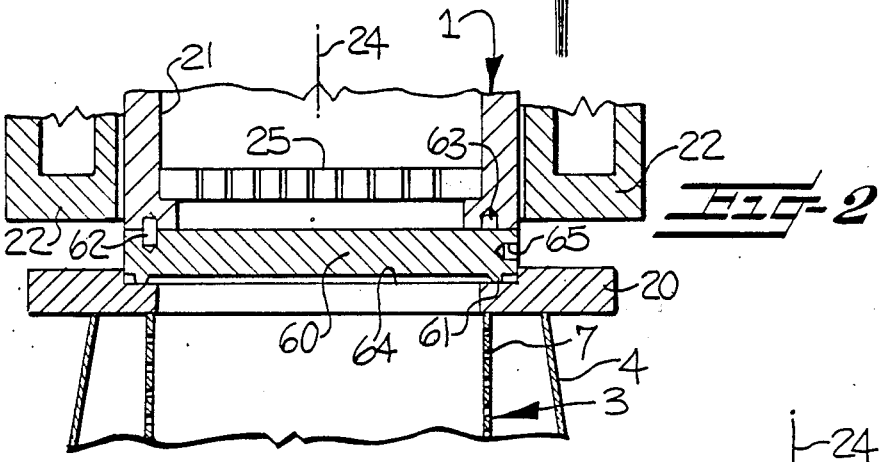
FIG. 2 is a fragmentary sectional view of one embodiment of a portion of the apparatus shown in FIG. 1, and specifically illustrating one embodiment of the casing assembly means in accordance with the present invention.

In the embodiments of FIGS. 1 and 2, once the connection 23 has been released, the movable section 7 of the spinning tube may be pushed manually into the stationary section 6, against the force of the counterweight 18. As a result, the individual spinning stations become easily accessible. The section 7 of the spinning tube may also be moved up and down by other suitable means, for example by a reversible drive motor, or a hydraulic or pneumatic drive system.

In accordance with the present invention, the melt spinning apparatus further includes casing assembly means mounted to the end of the section 7 of the spinning tube 3 which is adjacent the outlet end of the casing 21, for facilitating threaded assembly and disassembly of the casing from the melt supply block 72. The casing assembly means is adapted for rotation about the central axis 24, and includes means for engaging the outlet end of the casing 21 so as to impart rotation thereto upon rotation of the casing assembly means. In the embodiment of FIG. 2, the casing assembly means comprises a flat plate 60, which is mounted on the flange 20 at the upper end of the section 7 and blowing chamber 4. To assist in the centering of the plate 60, a shallow annular recess 64 is provided in the upper surface of the flange 20, with the diameter of the recess corresponding to the outside diameter of the plate 60. To reduce friction, the plate 60 is provided on its underside with a concentric annular bead 61. Also, the means for engaging the outlet end of the casing comprises a plurality of axial bores 63 formed in the outlet end of the casing, and a corresponding number of axially extending pins 62 mounted on the upper side of the plate 60. The pins 62 are arranged in a circle, and thus are adapted to engage respective ones of the bores 63. The number of pins 62 should not exceed the number of bores 63, although they may be fewer in number.

In the embodiment of FIG. 2, the cylindrical outer circumference of the plate 60 contains one or more radial bores 65 adapted for the insertion of a turning tool, such as a rod. Alternatively, the plate may include flattened surfaces about its periphery which are adapted for engagement by a wrench.

For removing the tubular casing 21 from the melt supply block 72, it will be understood that the feed of the melt initially should be terminated. Further, the connection 23 is released. The assembly consisting of the blowing chamber 4 and the upper section 7 of the spinning tube may then be pushed downwardly, and the plate 60, which is not present during normal operation of the spinneret, may then be inserted into the recess 64 of the flange 20. A suitable lubricant may be applied to the surface of the recess 64, to facilitate the rotation of the plate 60. Thereafter, the upper section 7 of the spinning tube and the blowing chamber 4 are moved upwardly, and plate 60 is rotatably positioned in such a way that the pins 62 are in alignment with and fit into the bores 63 in the tubular casing 21. A suitable turning tool, such as a rod, is inserted into a radial bore 65, and the plate 60 together with the casing 21 is rotated about the central axis 24, until the casing is released from the plug 74 of the block 72 and can be removed therefrom. The nozzle assembly, including the spin plate 82, nozzle 25, filters 86, and other components may then be cleaned or replaced.

A reconditioned or new spinning nozzle assembly may be reassembled by positioning the casing 21 upon the plate 60 in such a way that the pins 62 are again in alignment with and fit into the bores 63 of the new casing. The assembly consisting of the blowing chamber 4 and upper section 7 of the tube is then moved upwardly to a position where the casing comes into contact with the thread 77 of the plug 74 by which it is affixed to the melt supply block 72. The plate 60 is then again rotated, with a suitable tool being inserted into the bore 65. Thereafter, the assembly of the blowing chamber 4 and upper section 7 is pushed downwardly, and the plate 60 is removed from the flange 20. As a final step, the flange 20 is again brought into contact with the outlet end of the casing 21.

In an alternative embodiment, the plate 60 may include a central bore (not shown), the diameter of which at least corresponds with the diameter of the bore at the outlet end of the casing 21. In this case, it is possible to leave the plate 60 permanently in the recess 64 of the flange 20. Also, in this embodiment, it is preferable that a suitable ring of insulation be provided between the plate 60 and the casing 21, such a illustrated at 69 in FIG. 3.

Figure 3:
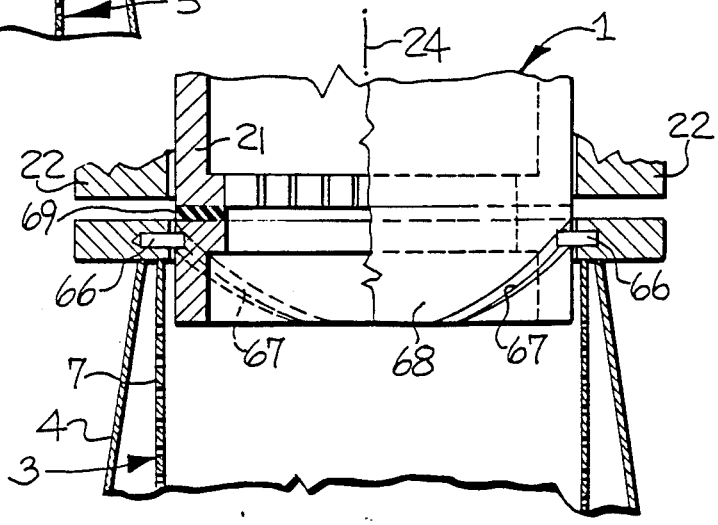
FIG. 3 is a view similar to FIG. 2, and illustrating a second embodiment of the casing assembly means.

FIG. 3 illustrates another embodiment of the casing assembly means of the present invention, and wherein the casing assembly means takes the form of an annular ring 68 which is permanently assembled to the flange 20. It should be noted however, that these embodiments are only exemplary, and that other means for removing and inserting the casing may be designed utilizing the disclosed principles. In the embodiment of FIG. 3, the casing assembly means comprises the ring 68, which is dimensioned so that it fits with little play within the cylindrical through bore of the flange 20. The ring 68 includes an outer cylindrical surface, and a number of thread like grooves 67 of relatively high pitch are equally spaced apart from each other about the circumference of the outer surface of the ring 68. Cooperating with the grooves 67 are radially inwardly directed pins 66, which are mounted in the wall of the through bore of the flange 20, with the length of pins 66 being dimensioned so that they freely move in the grooves 67. If desired, the pin diameter may be dimensioned so that the pins can be moved in the groove 67 only with a certain amount of force. Also, the upper surface of the ring 68 mounts an insulating ring 69, which is designed to minimize losses of heat.

Suitable means are provided to prevent the mounting ring 68 from falling through the bore of the flange 20.

For example, the upper ends of the grooves 67 as shown in FIG. 3 may be closed. Alternatively, the ring 68 may be provided at its upper edge with a collar, which is seated on the flange 20 when the collar reaches its lowest position.

To now describe the method of inserting a reconditioned nozzle assembly in accordance with the embodiment of FIG. 3, it will be understood that the assembly of the blowing chamber 4 and upper section 7 of the spinning tube is initially moved downwardly. The annular ring 68 is then rotated about the axis 24 until the pins 66 reach the lower most ends of the grooves 67, and such that the ring 68 protrudes above the upper surface of the flange 20. The insulating ring 69 and the reconditioned nozzle assembly are then positioned on top of the ring 68, and the blowing chamber 4 and upper section 7 of the spinning tube are then moved upwardly. The casing 21 will thereby come into contact with the threads 77 of the plug 74 to which it is to be affixed, and by proper design of the thread 77 of the plug and the grooves 67 so that they have the same degree of inclination or pitch, the ring 68 and casing 21 will be rotated about the axis 24 by the further upward movement of the flange 20, to secure the casing to the plug 74.

In the embodiment of FIG. 3, the friction developed between the ring 68, insulating ring 69 and outlet end of the nozzle casing 21, is sufficiently high to transmit a rotational torque from the ring 68 to the casing 21. In this regard, it should be noted that pins may also be provided on the ring 68 which fit into bores of the casing in the manner shown in FIG. 2.

A further embodiment of the casing assembly means of the present invention is illustrated in FIG. 4. This figure illustrates the spinneret 1 as described above, and also shows the upper section 7 of the spinning tube, the blowing chamber 4, the flange 20 connecting both, and the annular ring 68 connected to the flange 20 by means of pins 66 which match with thread like grooves 67. Also, a number of retainers 27 are secured to the upper surface of annular ring 68. These retainers match with recesses 26 on the periphery of the flange at the lower end of the nozzle casing 21. The retainers have on their one side an extension 28 fitting into a corresponding offset of recess 26. For assembling the nozzle casing 1 to plug 74 of the spinning beam, the new nozzle casing is placed on top of the insulating ring 69 and annular ring 68, the entry portion of the recess 26 being wide enough to permit extension 28 to enter into the recess. Upon the upper section 7 of the spinning tube being moved upwardly, pins 66 in grooves 67 will cause a rotational movement of annular ring 68 which is transferred to the nozzle casing by the left-hand flank of each retainer 27, as shown in FIG. 4. Thereby nozzle casing 21 is threaded onto the plug 74. For disassembly, the upper section 7 and flange 20 perform a downward movement which is transferred to the annular ring together with a rotational movement in the opposite sense. The rotational movement of the annular ring is transmitted to the nozzle casing by the right-hand flank of each retainer 27, and the downward axial movement is transmitted thereto by the extension 28.

An important aspect of the present invention is that it facilitates the automation of the assembly and disassembly of the nozzle in spinning machines for synthetic fibers. The manual operations are reduced by this invention to transporting and placing the nozzle assembly on top of the upper section of the spinning tube.

In the drawings and specification, there has been set forth a preferred embodiment of the invention, and although specific terms are employed, they are used in a generic and descriptive sense only and not for purposes of limitation.

That which is claimed is:

1. A melt spinning apparatus for extruding and spinning a thermoplastic material to form a plurality of filaments, and comprising a spinneret comprising a melt supply block and a nozzle assembly, said nozzle assembly including a tubular casing threadedly mounted to said melt supply block so as to define a central axis and such that said casing may be readily assembled to and disassembled from said block by rotation of said casing about said central axis, and with said tubular casing having an open outlet end disposed coaxially about said central axis, a spinning tube disposed in coaxial alignment with said outlet end of said tubular casing of said nozzle assembly, means mounting said spinning tube so that at least the portion thereof adjacent said outlet end of said tubular casing is axially movable between an operative position in contact with said outlet end and an axially withdrawn position, and casing assembly means mounted to the end of said spinning tube adjacent said outlet end for rotation about said central axis and including means for engaging said outlet end of said casing so as to impart rotation thereto upon rotation of said casing assembly means to thereby facilitate threaded assembly and disassembly of said tubular casing with respect to said melt supply block.

2. The melt spinning apparatus as defined in claim 1 wherein said spinning tube comprises two telescopically interconnected tube sections, with a first section being disposed adjacent said outlet end of said casing and a second section being disposed axially remote from said outlet end, and said means mounting said tube includes means fixing said second tube section so that said first tube section may telescope thereinto and thus move axially toward and away from said outlet end.

3. The melt spinning apparatus as defined in claim 2 wherein the end portion of said spinning tube adjacent said outlet end of said casing includes a plurality of perforations, and said apparatus further comprises blowing chamber means surrounding said perforated end portion of said spinning tube for supplying a pressurized gas thereto.

4. The melt spinning apparatus as defined in claim 2 wherein said apparatus further comprises a flange fixedly mounted to the end of said spinning tube adjacent said tubular casing, and wherein said casing assembly means comprises an assembly plate rotatably supported by said flange, and with said means for engaging said outlet end of said casing being mounted to said plate.

5. The melt spinning apparatus as defined in claim 4 wherein said tubular casing includes a plurality of axially directed bores in said outlet end thereof, and said means for engaging said outlet end of said casing comprises a like number of axial pins mounted to said assembly plate for engaging respective ones of said bores.

6. The melt spinning apparatus as defined in claim 5 wherein said flange includes an annular recess in one surface thereof which is coaxially disposed about said central axis, and with said recess rotatably receiving said assembly plate therein, and wherein said assembly plate includes outer surface means adapted to be engaged by a turning tool.

7. The melt spinning apparatus as defined in claim 6 wherein said outer surface means of said assembly plate comprises at least one radial aperture formed in the outer periphery thereof.

8. The melt spinning apparatus as defined in claim 4 wherein said flange includes a through bore which is coaxial with said central axis, and said assembly plate comprises an annular ring which is coaxially mounted within said through bore, and further comprising thread means interconnecting said flange and said annular ring such that said ring is axially and rotatably movable with respect to said flange.

9. The melt spinning apparatus as defined in claim 8 wherein said annular ring includes an exterior cylindrical surface, and said thread means interconnecting said flange and annular ring comprises at least one thread groove of relatively large pitch formed on said exterior surface, and a radially directed pin mounted on said flange and disposed within said thread groove.

10. The melt spinning apparatus as defined in claim 9 wherein said means for engaging said tubular casing comprises a resilient annular member of heat insulating material interposed between said annular ring and said casing.

11. The melt spinning apparatus as defined in claim 8 wherein said means for engaging said tubular casing comprises retainer means releasably interconnecting said annular ring and said tubular casing for transmitting rotational and axial movement therebetween.

12. A melt spinning apparatus for extruding and spinning a thermoplastic material to form a plurality of filaments, and comprising a spinneret comprising a stationary melt supply block having a connecting plug mounted thereto, with a melt supply line extending through said block and said connecting plug, and a nozzle assembly including a spin plate having a plurality of openings extending therethrough and a tubular casing enclosing and supporting said spin plate and so as to define a cavity on one side of said spin plate, and with said tubular casing further defining an open outlet end and a central axis, thread means releasably interconnecting said casing to said connecting plug and such that said melt supply line communicates with said cavity and thus one side of said spin plate and such that said casing may be readily assembled to and disassembled from said connecting plug of said block by rotation of said casing about said central axis, a spinning tube disposed in coaxial alignment with said outlet end of said tubular casing of said nozzle assembly, means mounting said spinning tube so that at least the portion thereof adjacent said outlet end of said tubular casing is axially movable between an operative position in contact with said outlet end and an axially withdrawn position, and casing assembly means mounted to the end of said spinning tube adjacent said outlet end for rotation about said central axis and including means for engaging said outlet end of said casing so as to impart rotation thereto upon rotation of said casing assembly means in each direction to thereby facilitate threaded assembly and disassembly of said tubular casing with respect to said connecting plug.

13. The melt spinning apparatus as defined in claim 12 wherein said connecting plug has a circular cross section, and said casing has a circular internal bore which is adapted to coaxially receive said connecting plug therein, and wherein said thread means includes cooperating threads formed on the connecting plug and casing.

14. The melt spinning apparatus as defined in claim 13 wherein said apparatus further comprises a flange fixedly mounted to the end of said spinning tube adjacent said tubular casing, and wherein said casing assembly means comprises a flat circular plate rotatably supported by said flange, and wherein said means for engaging said outlet end of said casing includes at least one axially directed bore in said outlet end, and at least one axial pin mounted on said circular plate for engaging respective ones of said bores.

15. The melt spinning apparatus as defined in claim 14 wherein said circular plate includes outer surface means adapted to be engaged by a turning tool.

16. The melt spinning apparatus as defined in claim 13 wherein said apparatus further comprises a flange fixedly mounted to the end of said spinning tube adjacent said tubular casing, and wherein said flange includes a through bore which is coaxial with said central axis, and wherein said casing assembly means comprises an annular ring mounted coaxially within said through bore of said flange, and further comprising thread means interconnecting said flange and said annular ring such that said ring is axially and rotatably movable with respect to said flange.

* * * * *